US010041651B1

(12) United States Patent
Xi

(10) Patent No.: US 10,041,651 B1
(45) Date of Patent: Aug. 7, 2018

(54) PROJECTION LAMP

(71) Applicant: Guangdong YUHAO Electronics Co., Ltd., Dongguan (CN)

(72) Inventor: Jun Xi, Dongguan (CN)

(73) Assignee: GUANGDONG YUHAO ELECTRONICS CO., LTD, Dongguan (CN)

( * ) Notice: Subject to any disclaimer, the term of this patent is extended or adjusted under 35 U.S.C. 154(b) by 0 days.

(21) Appl. No.: 15/821,714

(22) Filed: Nov. 22, 2017

(30) Foreign Application Priority Data

Aug. 8, 2017 (CN) ..... 2017 2 1003485 U

(51) Int. Cl.

| | |
|---|---|
| ***F21V 17/02*** | (2006.01) |
| ***F21V 14/00*** | (2018.01) |
| ***F21V 5/04*** | (2006.01) |
| ***F21S 10/00*** | (2006.01) |
| ***F21V 21/14*** | (2006.01) |
| ***F21V 23/00*** | (2015.01) |
| *F21Y 115/10* | (2016.01) |

(52) U.S. Cl.
CPC ..... *F21V 14/00* (2013.01); *F21S 10/00* (2013.01); *F21V 5/04* (2013.01); *F21V 21/14* (2013.01); *F21V 23/005* (2013.01); *F21Y 2115/10* (2016.08)

(58) Field of Classification Search
USPC ..... 362/282
See application file for complete search history.

(56) References Cited

U.S. PATENT DOCUMENTS 4,991,063 A * 2/1991 Stoneham ..... F21V 13/04 362/18

* cited by examiner

*Primary Examiner* — Jamara Franklin
(74) *Attorney, Agent, or Firm* — Hemisphere Law, PLLC; Zhigang Ma

(57) ABSTRACT

A projection lamp includes a transparent first shell, a second shell connected with the first shell, a light source seat, a light source fixed on the light source seat, a hollow cylinder-shaped light processing cylinder, and a driving device connected with the light processing cylinder. The light source and at least one part of the light source seat are received in the light processing cylinder, and do not rotate along with the light processing cylinder. The projection lamp of the present invention utilizes the light processing cylinder, so that a pattern projected is in a rolling state, and is unlikely to cause a dizzy feeling. Due to the fact that the transparent first shell is adopted, through a preset light processing effect designed on the first shell, the change of the projected pattern is more abundant and more interesting.

15 Claims, 1 Drawing Sheet

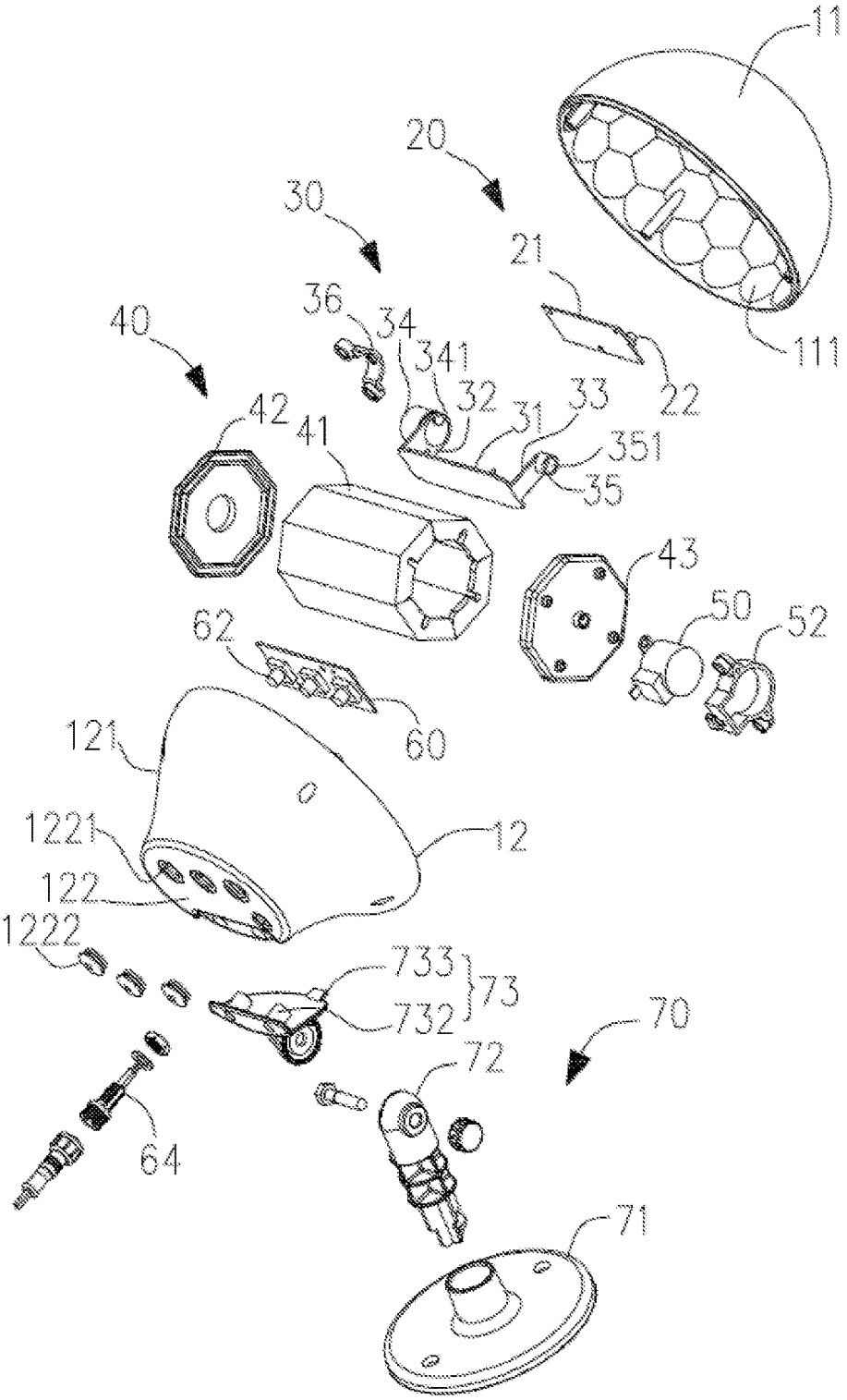
11
20
30
21
36
34
341
40
32
33
22
111
42
41
31
351
35
43
50
52
62
60
121
12
1221
122
1222
733
73
732
70
72
64
71

PROJECTION LAMP

BACKGROUND OF THE INVENTION

1. Field of the Invention

The present invention relates to projection equipments, and specifically relates to a projection lamp capable of projecting rotating images.

2. Description of Related Art

Existing projection lamps are mostly kaleidoscope type projection lamps. The projection lamp drives grain expanding sheets to rotate at 360 degrees by using a motor, a projected pattern can rotate peripherally, and the observed effect is that the pattern rotates in a visual range, so that aesthetic fatigue is easily caused, and a dizzy feeling is generated.

Therefore, an improved projection lamp whose projected patterns are in a rolling state and the change of the patterns is more abundant is needed.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawing, in which:

The FIGURE is an explosive view of a projection lamp in accordance with an embodiment of the present invention.

DETAILED DESCRIPTION OF THE INVENTION

The invention will now be described in detail through several embodiments with reference to the accompanying drawings.

As shown in the FIGURE, in an embodiment, the projection lamp of the present invention includes a housing formed by connecting a first shell 11 and a second shell 12. In the housing received a light source 20, a light source seat 30 used for fixing the light source 20, a light processing cylinder 40 used for carrying out a first optical processing on light emitted by the light source 20, a driving device 50 used for driving the light processing cylinder to rotate, a control panel 60 used for controlling the light source 20 and the driving device 50, and a fixed mount 70 connected to the outer side of the second shell 12.

The first shell 11 is made of a transparent material, such as transparent thermoplastic plastic Makrolon, and is used for carrying out a second optical processing on the light emitted by the light source 20. The first shell 11 is substantially in the shape of a hemispherical shell, the outer surface of the first shell 11 facing the outer side is smooth, and a plurality of bulges 111 are formed on the inner surface of the first shell 11 facing the light source 20. The bulges 111 are matched with the outer surface to form a plurality of convex lenses (magnifying glasses), and focusing processing is carried out on the light emitted from the light processing cylinder 40, so that the image projection distance is increased. In the embodiment, in the bulges, the edges of each of the bulges 111 those are close to the center of the first shell 11 is polygonal, and the sides of the adjacent bulges 111 are connected, the inner side of the first shell 11 look like a honeycomb at a distance. The sides, connected with adjacent bulges, of the bulges 111 whose are close to the edge of the first shell 11 are straight sides, and free sides are in the shapes of arcs.

The second shell 12 is made from a non-transparent material, is substantially in the shape of a cup, and is provided with a side wall 121 and a bottom 122. The second shell 12 is buckled with the first shell 11 and is fixedly connected with the first shell 11 to form an accommodating space, and the other components, except the fixed mount 70, of the projection lamp, are accommodated in the accommodating space.

The light source 20 is used for converting electric energy into optical energy, and in the embodiment, the light source 20 includes a circuit board 21 and a plurality of LED lamp beads fixed on the circuit board 21. For convenience in description, the normal of the circuit board 21 is defined to be the light emitting direction of the LED lamp beads, namely the light emitting direction of the light source. Wherein, the normal of the circuit board 21 passes through the first shell 11, and the center of the circuit 21 is opposite to the center of the first shell 11.

The light source seat 30 is used for fixing the light source 20, and includes a fixed plate 31 used for fixing the light source 20, two side plates 32, 33 extending perpendicularly from the fixed plate 31, and a first fixed part 34 and a second fixed part 35 extending perpendicularly from the outer sides (the opposite sides of the two side plates being the inner sides, the reverse sides of the two side plates being the outer sides) of the side plates 32, 33. In the embodiment, the first fixed part 34 and the second fixed part 35 are cylinder-shaped or column-shaped. A groove 341 is formed in the side face, facing the first shell 11, of the first fixed part 34, so that a fixed piece 36 is fixed on the inner side of the side wall 121 of the second shell 12. The fixed piece 36 is fixedly connected with the inner side of the side wall of the second shell 12, and a wedge for the groove to insert is formed in the fixed piece 36. A hole or a pit 351 is formed in the tail end, facing the side wall of the second shell 12, of the second fixed part 35, and the second fixed part 35 is rotatably connected with the light processing cylinder 40.

The light processing cylinder 40 is hollow cylinder-shaped, and is used for carrying out first optical processing on the light emitted by the light source 20, and specifically the optical processing includes the effect after light passes through a water surface, the effect after reflection of light passing through the water surface, or the shadow effect of a water flow or a waterfall falling effect. In the embodiment, the light processing cylinder 40 includes an octagonal cylinder part 41 and a first cover 42 and a second cover 43 fixed at two ends of the cylinder part 41. Wherein the cylinder part 41 is made of transparent water wave sheets, the surfaces of the water wave sheets are unevenly concave-convex, and after light passes through the water wave sheets, the patterns formed on a projection surface are similar to patterns formed by light which just passed through water waves or reflected by surfaces of water waves, or reflected by a water flow, or reflected by falling water, so that the water wave sheets are called. In other words, the water wave sheets are capable of processing light into an effect imitating light passes through water waves, an effect imitating light reflected by surfaces of water waves, a light shadow effect imitating light reflected by a water flow, or a waterfall falling effect imitating light reflected by falling water. In the embodiment, the figures of the water wave sheets on the eight surfaces of the cylinder part 41 are different, so that the generated water wave patterns are different, the change of the patterns is abundant, the patterns are in a vertical rolling state, and dizziness cannot be caused.

A through hole is formed in the center of the first cover 42, and posts are formed in the center of the second cover 42 facing the inner side and the outer side respectively. The first fixed part 34 of the light source seat 30 passes through the through hole in the center of the first cover 42 and is connected with the side wall 121 of the second shell 12, so that the light source seat 30 is fixed relative to the second shell 12. The hole or the pit 351 in the second fixed part 35 of the light source seat 30 is connected onto the post on the inner side of the second cover 43 in a sleeving manner, so that when the light processing cylinder 40 rotates, the light source seat 30 does not rotate. The rotating shaft of the light processing cylinder 40 is substantially perpendicular to the light emitting direction of the light source 20, so that the light emitted from the cylinder part 41 can be emitted to the first shell.

The driving device 50 is used for driving the light processing cylinder 40 to rotate, and the driving end of the driving device 50 is fixedly connected with the post on the outer side of the second cover 43, so that when the driving end rotates, the light processing cylinder 40 is driven to rotate. The driving device 50 is fixed on the inner side of the side wall 121 of the second shell 12 through a fixed mount 52. In the embodiment, the driving piece 50 is a motor.

The control panel 60 is electrically connected with the driving device 50 of the light source 20, and is fixed on the inner side of the bottom 122 of the second shell 12. A plurality of switches 62 are arranged on the control panel 60. Holes 1221 for the switches to stretch are formed in the bottom 122 of the second shell 12 at the positions corresponding to the switches 62. A plurality of switch cover caps 1222 are sleeved on the switches 62 from the outer side of the bottom 122. A power supply end is inserted into a wire hole in the bottom 122, and is electrically connected with the control panel 60.

The fixed mount 70 is connected to the second shell 12 on the outer side of the shell, and is used for supporting a lamp body and determining the light emitting direction of the lamp body. In the embodiment, the fixed mount 70 includes a base 71, a supporting rod 72 extending perpendicularly from the base 71, and a connecting seat 73 rotatably connected with the tail end of the supporting rod 72. Wherein the connecting seat 73 is at least made of a metal material, is fixedly connected with the bottom 122 of the second shell 12 through a screw, and is used for inserting the column body 732 of the screw as a heat conducting part, and heat inside the shell can be conducted to the outside of the shell. Particularly, an extending sheet 733 is further arranged on the connecting seat 73, the extending sheet 733 is inserted into the second shell 12 from a through groove (unshown) in the second shell 12, and is directly or indirectly in contact with the driving device 50, so that the heat conducting part is used for conducting the heat on the driving device to the outside of the shell. Therefore, the projection lamp of the present invention has good heat dissipation performance.

In the first embodiment, the light source 30 is mostly positioned inside the light processing cylinder, and just a part of the first fixed part 34 stretches out of the light processing cylinder 40 to be connected with the second shell 12. In other embodiments, through holes are formed in the center of the first cover and the center of the second cover respectively, the first fixed part passes through the through hole in the center of the first cover and is connected with the inner side wall of the second shell, and the second fixed part is connected with the driving device, but does not rotate along with the driving end of the driving device. The driving device can be connected with the inner side wall of the second shell through a fixed column passing through the through hole in the center of the second cover, and can reach the function and effect same as those in the first embodiment. Therefore, the driving device is fixed inside the light processing cylinder. In another variant, the second fixed part can pass through the through hole in the driving device and the through hole in the center of the second cover and is connected with the inner side wall of the second shell, namely the driving device is fixedly connected with the second fixed part and is positioned inside the light processing cylinder. In another variant, the second fixed part can pass through the through hole in the center of the second cover and is connected with the inner side wall of the second shell, the driving device is also fixed onto the fixed part, and the driving end of the driving device is connected with the second cover. In another variant, the second fixed part passes through the through hole in the center of the second cover and is fixedly connected with the driving device, but does not rotate along with the driving end of the driving device, the driving device is fixed between the second shell and the second cover, the driving end of the driving device is connected with the outer side of the second cover, and the function and effect same as those in the first embodiment can be reached.

In the first embodiment, the circuit board of the light source is in the shape of a flat plate, in other embodiments, the circuit board of the light source can be arc-shaped or similarly hemispherical, so that the light emitted by an LED can emit to each point of the first shell, and right now, the rotating shaft of the light processing cylinder can be perpendicular to the connecting line from the center of the light source (physical centers of all LED lamp beads) to the center of the first shell.

The projection lamp of the present invention adopts the light processing cylinder of which the rotating shaft is substantially perpendicular to the light emitting direction of the light source, so that a pattern projected by light rays processed by the light processing cylinder is in a vertical or transverse rolling state, and is unlikely to cause a dizzy feeling. Due to the fact that the transparent first shell is adopted, through a preset light processing effect designed on the first shell, the change of the projected pattern is more abundant and more interesting.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A projection lamp, comprising:

a transparent first shell; and a second shell connected with the first shell so as to define an accommodating space receiving:

a light source seat fixed on an inner side wall of the second shell;

a light source fixed on the light source seat, a light emitting direction of the light source facing the first shell;

a hollow cylinder-shaped light processing cylinder; and a driving device with a driving end connected with the light processing cylinder and configured for driving the light processing cylinder to rotate around a rotating shaft substantially perpendicular to the light emitting direction of the light source or perpendicular to a connecting line from a center of the light source to a center of the first shell;

wherein the light source and at least one part of the light source seat are positioned inside the light processing cylinder, and do not rotate along with the light processing cylinder.

2. The projection lamp according to claim 1, wherein the light processing cylinder is a polygonal hollow cylinder made of water wave sheets capable of processing light into an effect imitating light passes through water waves, an effect imitating light reflected by surfaces of water waves, a light shadow effect imitating light reflected by a water flow, or a waterfall falling effect imitating light reflected by falling water.

3. The projection lamp according to claim 1, wherein the first shell is a substantially hemispherical shell, an outer surface of the first shell is smooth, an inner surface of the first shell faces the light source and defines a plurality of bulges, and the plurality of bulges form a plurality of convex lenses.

4. The projection lamp according to claim 3, wherein in the plurality of bulges, edges of each of bulges those close to the center of the first shell forms a polygonal shape, and the edges of adjacent bulges are connected.

5. The projection lamp according to claim 3, wherein the light processing cylinder is a polygonal hollow cylinder made of water wave sheets capable of processing light into an effect imitating light passes through water waves, an effect imitating light reflected by surfaces of water waves, a light shadow effect imitating light reflected by a water flow, or a waterfall falling effect imitating light reflected by falling water.

6. The projection lamp according to claim 5, wherein the light processing cylinder is polygonal, a polygonal first cover and a polygonal second cover are fixed at two ends of the light processing cylinder respectively to cover openings defined in the two ends of the light processing cylinder, a through hole is defined in a center of the first cover, and posts extending perpendicular from a center of an inner side and an outer side of the second cover respectively.

7. The projection lamp according to claim 6, wherein the light source seat comprises:

a fixed plate configured for fixing the light source;

two side plates extending perpendicularly from the fixed plate; and a first fixed part and a second fixed part extending perpendicularly from the two side plates respectively towards outside of the light source seat;

wherein the first fixed part passes through the through hole in the center of the first cover and is connected with the inner side wall of the second shell; the second fixed part is rotatably sleeved on the post on the inner side of the second cover; the driving end of the driving device is fixedly connected with the post on the outer side of the second cover, and the driving device is fixed onto the inner side wall of the second shell.

8. The projection lamp according to claim 7, further comprising a control panel fixed to the inner side wall of the second shell, a plurality of switches are configured on the control panel, a plurality of holes for the plurality of switches to stretch are defined in the second shell at positions corresponding to the plurality of switches; and the light source and the driving device are electrically connected with the control panel.

9. The projection lamp according to claim 8, further comprising a fixed mount, an upper end of the fixed mount is made of a metal material and is connected with a bottom of the second shell, and the upper end of the fixed mount is provided with a heat conducting part inserted into the bottom of the second shell.

10. The projection lamp according to claim 9, wherein the heat conducting part is in contact with the driving device.

11. The projection lamp according to claim 5, wherein the light processing cylinder is polygonal, a polygonal first cover and a polygonal second cover are fixed at two ends of the light processing cylinder respectively to cover openings defined in the two ends of the light processing cylinder, through holes are formed in centers of the first cover and the center of the second cover respectively.

12. The projection lamp according to claim 11, wherein the light source seat comprises:

a fixed plate configured for fixing the light source;

two side plates extending perpendicularly from the fixed plate; and a first fixed part and a second fixed part extending perpendicularly from the two side plates respectively towards outer side of the light source seat;

wherein the first fixed part passes through the through hole in the center of the first cover and is connected with the inner side wall of the second shell; the second fixed part is connected with the driving device, but does not rotate along with the driving end of the driving device, and the driving device is connected with the inner side wall of the second shell through a fixed column passing through the through hole in the center of the second cover.

13. The projection lamp according to claim 11, wherein the light source seat comprises:

a fixed plate configured for fixing the light source;

two side plates extending perpendicularly from the fixed plate; and a first fixed part and a second fixed part extending perpendicularly from the two side plates respectively towards outer side of the light source seat;

wherein the first fixed part passes through the through hole in the center of the first cover and is connected with the inner side wall of the second shell; the second fixed part passes through the through hole in the driving device and the through hole in the center of the second cover to be connected with the inner side wall of the second shell.

14. The projection lamp according to claim 11, wherein the light source seat comprises:

a fixed plate configured for fixing the light source;

two side plates extending perpendicularly from the fixed plate; and a first fixed part and a second fixed part extending perpendicularly from the two side plates respectively towards outer side of the light source seat;

wherein the first fixed part passes through the through hole in the center of the first cover and is connected with the inner side wall of the second shell; the second fixed part passes through the through hole in the center of the second cover and is connected with the inner side wall of the second shell, the driving device is fixed on the fixed plate, and the driving end of the driving device is connected with the second cover.

15. The projection lamp according to claim 11, wherein the light source seat comprises:

a fixed plate configured for fixing the light source;

two side plates extending perpendicularly from the fixed plate; and a first fixed part and a second fixed part extending perpendicularly from the two side plates respectively towards outer side of the light source seat;

wherein the first fixed part passes through the through hole in the center of the first cover and is connected with the inner side wall of the second shell; the second fixed part passes through the through hole in the center of the second cover to be fixedly connected with the driving device, but does not rotate along with the driving end of the driving device, the driving device is fixed between the second shell and the second cover, and the driving end of the driving device is connected with the outer side of the second cover.

* * * * *